US010215374B2

(12) United States Patent
Xu et al.

(10) Patent No.: US 10,215,374 B2
(45) Date of Patent: Feb. 26, 2019

(54) ANGLE-ADJUSTABLE LAMP

(71) Applicant: Ningbo Yamao Optoelectronics Co., Ltd., Zhejiang (CN)

(72) Inventors: Qili Xu, Zhejiang (CN); Hu Fang, Zhejiang (CN); Yinyong Zhou, Zhejiang (CN)

(73) Assignee: NINGBO YAMAO OPTOELECTRONICS CO., LTD., Zhenjiang (CN)

( * ) Notice: Subject to any disclaimer, the term of this patent is extended or adjusted under 35 U.S.C. 154(b) by 0 days.

(21) Appl. No.: 15/710,124

(22) Filed: Sep. 20, 2017

(65) Prior Publication Data

US 2018/0224091 A1 Aug. 9, 2018

(30) Foreign Application Priority Data

Feb. 9, 2017 (CN) ..... 2017 1 0071787

(51) Int. Cl.
*F21V 17/02* (2006.01)
*F21V 17/12* (2006.01)
*F21V 19/00* (2006.01)

(52) U.S. Cl.
CPC ..... *F21V 17/02* (2013.01); *F21V 17/12* (2013.01); *F21V 19/006* (2013.01)

(58) Field of Classification Search
None
See application file for complete search history.

(56) References Cited

U.S. PATENT DOCUMENTS 4,300,187 A * 11/1981 Fletcher ..... F21V 17/02 362/223
5,584,574 A * 12/1996 Haddad ..... F21V 11/00 362/280
6,979,108 B1 * 12/2005 Berge ..... F04D 25/088 362/147
2012/0236577 A1 * 9/2012 Cheng ..... F21V 29/004 362/373

* cited by examiner

*Primary Examiner* — Sharon E Payne
(74) *Attorney, Agent, or Firm* — Andrew F. Young, Esq.; Lackenbach Siegel, LLP

(57) ABSTRACT

The invention provides an angle-adjustable lamp and relates to the technical field of lighting. An angle-adjustable lamp comprises a fixing socket which is provided with a lamp hole, a rotating ring which rotates inside the protrusion of the outer edge of lamp hole, a fixing ring reversely sleeved on the protrusion and the lamp body connected to the rotating ring through two protrusions; by arranging the annular protrusion in the rim of the lamp hole and embedding rotating ring inside the protrusion, the rotation of the rotating ring along the center of lamp hole is ensured, and the limitation of rotation angle of lamp is extended; by arranging the annular fixing ring in the protrusion, raising and falling motion of rotating ring can be prevented effectively, therefore, the rotation process becomes more smooth.

8 Claims, 2 Drawing Sheets

ANGLE-ADJUSTABLE LAMP

CROSS-REFERENCE TO RELATED APPLICATIONS

The present application claims priority to and the benefit of Chinese Patent Application No. CN 201710071787.4, filed on Feb. 9, 2017, the entire content of which is incorporated herein by reference.

BACKGROUND OF THE INVENTION

1. Field of the Invention

The invention relates to the field of illuminating lamp, more specifically, to an angle-adjustable lamp.

2. Description of the Related Art

Lamps have become an important part and a necessary lighting tool in people's life, so there are more and more researches about lamps.

Due to the difference of working environments of lamps as well as the requirements of lightening, structural requirements of lamp has been increased accordingly to meet lightening needs of different uses. The existing lamps mainly comprise a fixing socket and a lamp body, and generally, the fixing socket is fixedly arranged within the area requiring lightening, and the lamp body is fixedly arranged on the fixing socket. If you need to change the lighting area, you need to relocate the fixing socket or re-install new lamps for lightening, the former is not only a waste of time and effort but also easy to damage the lamp, the latter wastes time and its cost is relatively high, and is not good for the modern lighting industry development.

In conclusion, the problem of current lamps on the market is that it cannot change the direction of lighting so that it results in waste.

SUMMARY OF THE INVENTION

In view of the above problems in the prior art, the invention is now intended to provide an angle-adjustable lamp, which sets a lamp holder which can transform a variety of angles and match with an adjustable lamp, and its transformation angle is great hereinto. Therefore, the lamp can be applied to different illumination environment and has high adaptability, thus avoiding the waste resulting from re-installation of lamps.

Specific technical solutions are as follows:

An angle-adjustable lamp, comprises: a fixing socket, a fixing ring, a rotating ring and a lamp body, wherein, the middle part of fixing socket is provided with a round lamp hole, an annular sheet-like protrusion is arranged on a rim of the lamp hole in the fixing socket, a cross-section shape of the protrusion presents a "J"-shape, and a short edge of the protrusion faces towards a center of the lamp hole;

the rotating ring is arranged to be a circle ring, a cross-section shape of the rotating ring presents a "L"-shape, and a vertical edge of the rotating ring faces towards the center of the rotating ring, the rotating ring is embedded inside the protrusion, and an outer wall of another vertical edge of the rotating ring attaches to an inner wall of a long edge of the protrusion, and a bottom surface of the rotating ring abuts against a top surface of a short edge of the protrusion;

the fixing ring is arranged to be an annular ring, a cross-section shape of the fixing ring presents a "J"-shape, the fixing ring is sleeved reversely on a top of a long edge of the protrusion, and a bottom surface of a short edge of the fixing ring is arranged oppositely to a top surface of a vertical edge of the long edge of the rotating ring attached to the protrusion;

a wall of the lamp body is provided with two protruded blocks symmetrically, and both protruded blocks are movably connected to a vertical edge of the rotating ring which is not attached to the long edge of the protrusion.

The above-mentioned angle-adjustable lamp, wherein: the two protruded blocks are arranged to be a hemispherical shape.

The above-mentioned angle-adjustable lamp, wherein: there are two brackets arranged symmetrically in a vertical edge of the rotating ring which is not attached to the long edge of the protrusion, and both brackets are arranged parallel to the vertical edges attached to the protrusion, and a rotating hole is arranged at one end of the vertical edge, which is deviated away from and is not attached to the protrusion, of the bracket, and the rotating hole matches with the protruded blocks.

The above-mentioned angle-adjustable lamp, wherein: a distance is arranged between the bottom of the lamp body and the bottom of the fixing socket.

The above-mentioned angle-adjustable lamp, wherein: the top of short edge of the fixing ring is provided with a plurality of projected limits and each limit is provided along a projected direction of the protrusion on the fixing socket.

The above-mentioned angle-adjustable lamp, wherein: the limits are configured into three sets of limits, and the limits are arranged on the fixing socket in a manner of polar array.

The above-mentioned angle-adjustable lamp, wherein: each limit includes two support plates, which are parallel to each other, and a connecting plate, the connecting plate is arranged between the two support plates and connects these two support plates, and a center of the connecting plate is arranged with a fixing hole, and a threaded fastener passes through the fixing hole to fix the connecting plate to the fixing socket.

The above-mentioned angle-adjustable lamp, wherein: a space is arranged between the bottom surface of the short edge of the fixing ring and the top surface of the long edge of the rotating ring.

The positive effects of the above technical solutions are: 1. by arranging the round lamp hole to facilitate the rotation of the lamp body, the range of rotation direction is widened; 2. the rotating ring is embedded inside the protrusion of the fixing socket and the movement of lamp body is arranged on the rotating ring, so the rotating ring can rotate around the axis of the lamp hole in the fixing socket and the angular restriction becomes smaller; 3. a fixing ring is reversely arranged on the protrusion, thus preventing the raising and falling motion of the rotating ring effectively and having better stability; 4. the lamp body is provided with the hemispherical protruded blocks, thus improving the rotation characteristics of lamp body in the rotating ring, having less restrictions, and becoming easy to disassemble and maintain; 5. a by arranging a plurality of limits, the lamp body is effectively prevented from rotating out of the fixing socket and damaging the lamp body , thus having a higher security.

BRIEF DESCRIPTIONS OF THE DRAWINGS

The accompanying drawings, together with the specification, illustrate exemplary embodiments of the present disclosure, and, together with the description, serve to explain the principles of the present invention.

Figure 1:
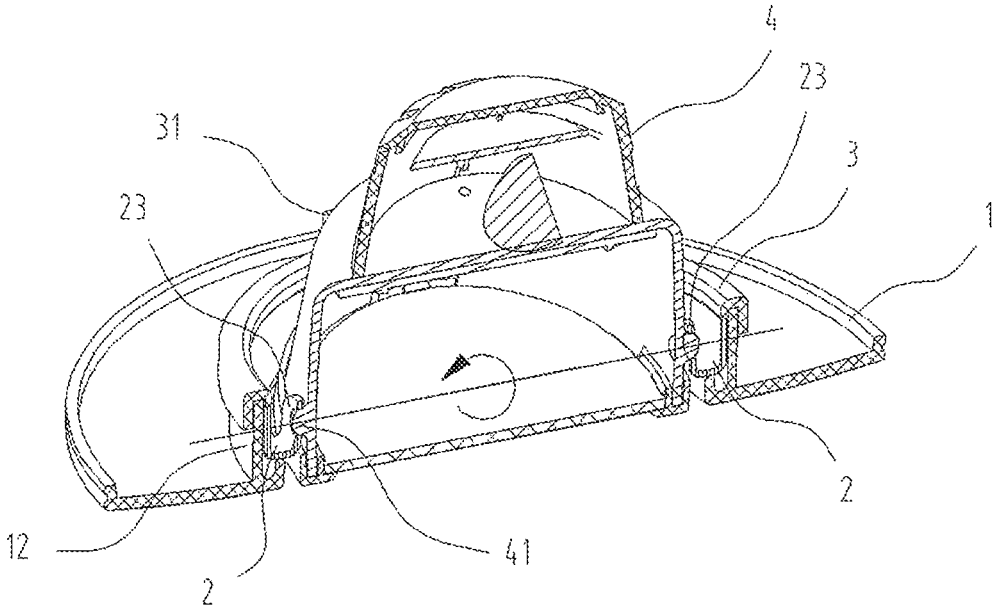
FIG. 1 is a structure diagram of an embodiment of an angle-adjustable lamp of the present invention.

In the drawings: 1, fixing socket; 11, lamp hole; 12, protrusion; 121, long edge of protrusion; 122, short edge of protrusion; 2, rotating ring; 21, vertical edge attached to the long edge of protrusion; 22, vertical edge not attached to the long edge of protrusion; 23, bracket; 231, rotating hole; 3, fixing ring; 31, limit; 311, support plate; 312, connecting plate; 313, fixing hole; 4, lamp body; 41, protruded block.

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

Figure 2:
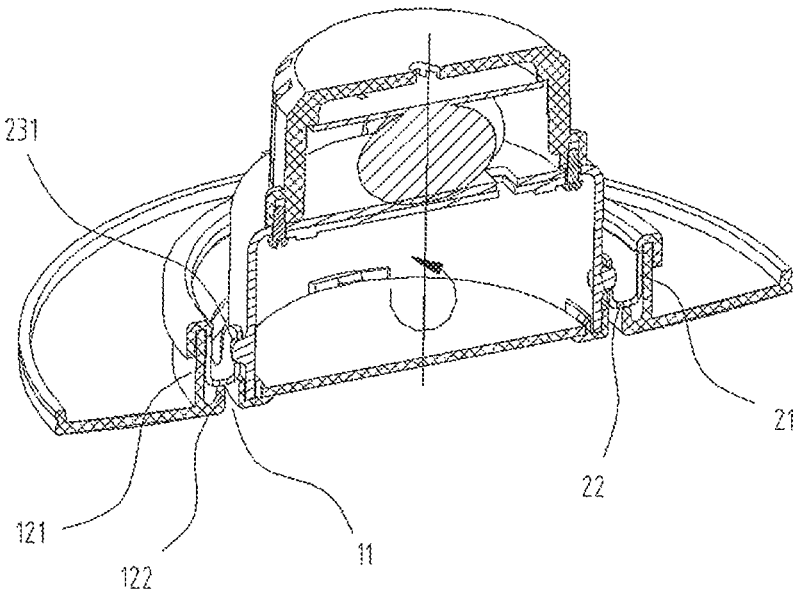
FIG. 2 is a perspective structure diagram of a preferred embodiment of the present invention.
Figure 3:
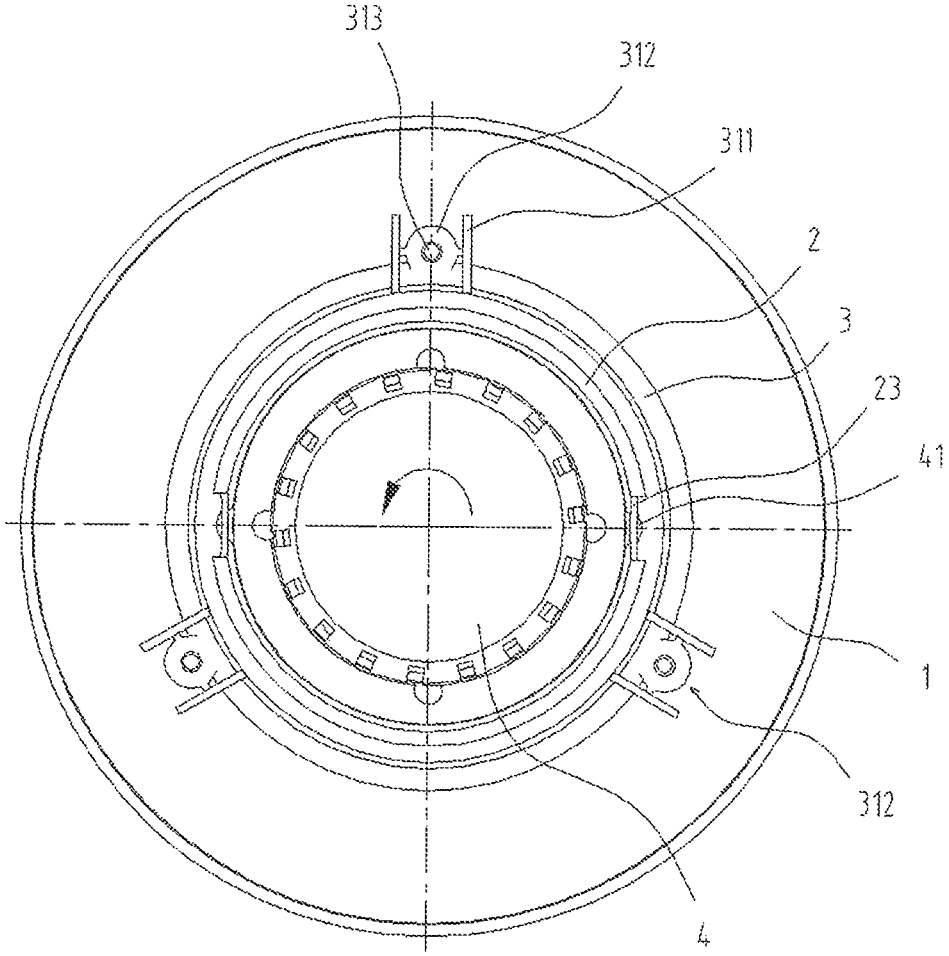
FIG. 3 is another perspective structure diagram of a preferred embodiment of the present invention.

In order to make the technical means, the authoring feature, the purpose and effectiveness of the present invention to be understood well, the following embodiments will now be described more fully hereinafter with reference to FIG. 1~FIG. 3. However, this invention should not be construed as limited to the embodiments set forth herein.

FIG. 1 is a structure diagram of an embodiment of an angle-adjustable lamp of the present invention; FIG. 2 is a perspective structure diagram of a preferred embodiment of the present invention; FIG. 3 is another perspective structure diagram of a preferred embodiment of the present invention. As shown in FIGS. 1 and 2, an angle-adjustable lamp in the present embodiment comprises: a fixing socket 1, a lamp hole 11, a protrusion 12, a long edge 121 of the protrusion 121, a short edge 122 of the protrusion, a rotating ring 2, a vertical edge 21 attached to the long edge of the protrusion, a vertical edge 22 not attached to the long edge of the protrusion, brackets 23, rotating holes 231, a fixing ring 3, limits 31, support plates 311, connecting plates 312, fixing holes 313, a lamp body 4 and protruded blocks 41.

Specifically, the fixing socket 1 is arranged to be a plate shape; and the lamp hole 11 is arranged in the middle part of the fixing socket 1; and the lamp hole 11 is arranged to be circular shape; and an annular protrusion 12 is arranged on the rim of lamp hole 11 in the fixing socket 1 and the protrusion 12 arranged to be sheet-like shape.

Specifically, the cross-section shape of the protrusion 12 presents a "J"-shape; and comprises a long edge 121 of the protrusion and a short edge 122 of the protrusion; and the long edge 121 of the protrusion and the short edge 122 of the protrusion are both arranged on the same side of the fixing socket 1; and short edge 122 of the protrusion faces the center of the lamp hole 11.

Specifically, a rotating ring 2 is embedded inside the protrusion 12; and the rotating ring 2 is arranged to be a circular ring; and the cross-section shape of the rotating ring 2 presents a "L"-shape; and the outer wall of a vertical edge of the rotating ring 2 attaches to the inner wall of the long edge 121 of protrusion, i.e., the vertical edge attached to long edge 21 of protrusion; and another vertical edge of the rotating ring 2 faces towards the center of the rotating ring 2, i.e., the vertical edge not attached to long edge 22 of protrusion. Besides, the bottom surface of the rotating ring 2 abuts against the top surface of the short edge 122 of the protrusion, thus realizing the purpose that rotating ring 2 rotates around the center of lamp hole 11 and the purpose of widening variation range of the rotation angle.

Specifically, two brackets 23 are arranged symmetrically in a vertical edge of the rotating ring 2 not attached to the long edge 22 of protrusion, and the arranged directions of the brackets 23 are parallel to the vertical edge 21 attached to long edge of protrusion, thus ensuring that the lamp body 4 supported by the bracket 23 does not collide with the rotating ring 2 during the movement, which improves security; and a rotating hole 231 is arranged at one end of the vertical edge 22, which is deviated away from and is not attached to the protrusion, of the bracket 23.

Specifically, a fixing ring 3 is provided at the top of the long edge 121 of the protrusion; and the fixing ring 3 is arranged to be annular shape; and the cross-section shape of the fixing ring 3 presents a "J"-shape; and the fixing ring 3 is sleeved reversely on the top surface of long edge 121 of protrusion; and the bottom surface of the short edge of the fixing ring 3 is arranged oppositely to the top surface of the vertical edge 21 of rotating ring 2 attaching to long edge of protrusion, thus effectively preventing rising and falling of rotating ring 2 during rotation and resulting in better stability.

More specifically, the lamp body 4 is arranged inside the lamp hole 11; and the lamp body 4 is provided with two protruded blocks 41 symmetrically; and the protruded blocks 41 matches with the rotating hole 231 on the bracket 23 of the rotating ring 2, so the lamp body 4 can rotate around the axis which is a connection line in the rotating holes 231 of two brackets 23 in lamp hole 11, which realizes multi-angle transformation of the lamp body 4.

More specifically, the fixing ring 3 is provided with a plurality of projected limits 31; and the limits 31 are arranged on the top surface of short edge of the fixing ring 3; and each limit 31 is provided along the projecting direction of protrusion 12 in the fixing socket 1; and the plurality of limits 31 are arranged on the fixing socket 1 in a manner of polar array.

More specifically, each limit 31 includes two support plates 311 and a connecting plate 312, and the connecting plate 312 is arranged between the two support plates 311 and connects these two support plates 311; and the center of connecting plate 312 is provided with a fixing hole 313; and these two support plates 311 are arranged parallel to each other; and the support plate 311 is fixed to the fixing socket 1 through a threaded fastener passing through the fixing hole 313 in connecting plate 312.

As a preferred embodiment, the limits 31 are configured into three sets, and the three sets of limit 31 are arranged on the fixing socket 3 in a manner of polar array, which helps to achieve the omnidirectional limit of the lamp body 4 with a minimum amount of material, thus effectively preventing the lamp body 4 from rotating out of the fixing socket 1 and damaging the lamp body 4, thereby improving the safety thereof.

As a preferred embodiment, a space is arranged between the bottom surface of the short edge of the fixing ring 3 and the top surface of the vertical edge 21 of the rotating ring 2 attached to long edge of protrusion, which facilitates the rotating ring 2 to rotate within the protrusion 12 of fixing socket 1, thereby reducing the frictional loss.

As a preferred embodiment, the protruded blocks 41 is arranged to be hemispherical shape, thus improving the rotation characteristics of the lamp body 4 in the rotating ring 2, thereby having less restriction, and becoming easy to disassemble and maintain.

As a preferred embodiment, a distance is arranged between the bottom of the lamp body 4 and the bottom of the fixing socket 1, thus effectively ensuring that the lamp body 4 does not touch the attachment (not shown) of the fixing socket 1 during rotation, thereby making lamp body 4 easier to transform angles.

The angle-adjustable lamp provided by the present embodiment, comprises: a fixing socket 1 which is provided with a lamp hole 11, a rotating ring 2 which rotates inside the protrusion 12 of the rim of the lamp hole 11, a fixing ring 3 reversely sleeved on the protrusion 12 and the lamp body 4 connected to the rotating ring 2 through the two protruded blocks 41; by arranging the annular protrusion 12 having a cross-section of "J"-shape in the rim of lamp hole 11 and embedding the rotating ring 2 inside the protrusion 12, the rotation of rotating ring 2 around the center of lamp hole 11 is ensured, and the limitation of rotation angle of the lamp is extended; by arranging the annular fixing ring 3 on the protrusion 12, raising and falling motion of the rotating ring 2 can be prevented effectively, therefore the rotation process becomes more smooth; by connecting lamp body 4 to the bracket 23 of rotating ring 2 through the protrusion 12, the lamp body 4 can rotate around the axis which is the connection line in the rotating holes 231 of two brackets 23, which further expands the rotation angle of lamp, achieves adjustability of the lighting angle of the lamp and avoids the waste from re-installation of the lamp; the limits 31 are arranged on the fixing ring 3, which effectively prevents the lamp body 4 from rotating out of the fixing socket 1 and damaging lamp body 4, thereby having higher safety.

The foregoing is only the preferred embodiments of the invention, not thus limiting embodiments and scope of the invention, those skilled in the art should be able to realize that the schemes obtained from the content of specification and figures of the invention are within the scope of the invention.

What is claimed is:

1. An angle-adjustable lamp, comprising: a fixing socket, a fixing ring, a rotating ring and a lamp body, wherein, a middle part of the fixing socket is provided with a round lamp hole, an annular sheet-like protrusion is arranged on a rim of the lamp hole in the fixing socket, and a short edge of the protrusion faces towards a center of the lamp hole;

the rotating ring is arranged to be a circle, a cross-section shape of the rotating ring presents an "L" shape, and a vertical edge of the rotating ring faces towards the center of the rotating ring, the rotating ring is embedded inside the protrusion, and an outer wall of another vertical edge of the rotating ring attaches to an inner wall of a long edge of the protrusion, and a bottom surface of the rotating ring abuts against a top surface of a short edge of the protrusion;

the fixing ring is arranged to be an circular, a cross-section shape of the fixing ring presents a "J" shape, the fixing ring is sleeved reversely on a top of a long edge of the protrusion, and a bottom surface of a short edge of the fixing ring is arranged oppositely to a top surface of a vertical edge of the long edge of the rotating ring attached to the protrusion;

a wall of the lamp body is provided with two protruded blocks symmetrically, and both protruded blocks are movably connected to a vertical edge of the rotating ring which is not attached to the long edge of the protrusion.

2. The angle-adjustable lamp according to claim 1, wherein the two protruded blocks are arranged to be a hemispherical shape.

3. The angle-adjustable lamp according to claim 2, wherein two brackets are arranged symmetrically in a vertical edge of the rotating ring which is not attached to the long edge of the protrusion, and both brackets are arranged parallel to the vertical edges attached to the protrusion, and a rotating hole is arranged at one end of the vertical edge, which is deviated away from and is not attached to the protrusion, of the bracket, and the rotating hole matches with the protruded blocks.

4. The angle-adjustable lamp according to claim 1, wherein a distance is arranged between the bottom of the lamp body and the bottom of the fixing socket.

5. The angle-adjustable lamp according to claim 1, wherein the top of the short edge of the fixing ring is provided with a plurality of projected limits and each limit is provided along a projected direction of the protrusion on the fixing socket.

6. The angle-adjustable lamp according to claim 5, wherein the limits are configured into three sets of limits, and the limits are arranged on the fixing socket in a manner of polar array.

7. The angle-adjustable lamp according to claim 6, wherein each limit includes two support plates, which are parallel to each other, and a connecting plate, the connecting plate is arranged between the two support plates and connects these two support plates, and a center of the connecting plate is arranged with a fixing hole, and a threaded fastener passes through the fixing hole to fix the connecting plate to the fixing socket.

8. The angle-adjustable lamp according to claim 1, wherein a space is arranged between the bottom surface of the short edge of the fixing ring and the top surface of the long edge of the rotating ring.

* * * * *